US006601356B2

(12) United States Patent
Snyder

(10) Patent No.: US 6,601,356 B2
(45) **Date of Patent: *Aug. 5, 2003**

(54) CONNECTOR FRAME FOR VENTILATION OPENING

(75) Inventor: Darryl L. Snyder, Canton, OH (US)

(73) Assignee: Snyder National Corporation, Canton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/793,259

(22) Filed: Feb. 26, 2001

(65) Prior Publication Data

US 2001/0032429 A1 Oct. 25, 2001

Related U.S. Application Data

(63) Continuation-in-part of application No. 09/146,671, filed on Sep. 3, 1998, now Pat. No. 6,192,640.

(51) Int. Cl.[7] ..... F24F 13/08; F24F 7/00; E04F 17/04

(52) U.S. Cl. ..... 52/302.1; 52/98; 52/198; 52/302.7; 52/473; 52/507; 52/656.8; 454/270; 454/271; 454/275; 454/277; 454/331; 220/3.5

(58) Field of Search ..... 52/98, 204.61, 52/302.1, 473, 507, 510, 656.1, 656.2, 656.8, 302.3, 302.7, 198; 454/270, 271, 275, 276, 277, 280, 330, 331, 367, 284, 358; 285/64; 248/27.1, 906; 220/3.3, 3.4, 3.5, 3.6, 3.8, 3.9, 3.92, 3.94

(56) References Cited

U.S. PATENT DOCUMENTS

| | | | | | |
|---|---|---|---|---|---|
| 1,959,132 | A | * | 5/1934 | Jones | 454/331 |
| 1,979,543 | A | * | 11/1934 | Heasley | 454/331 |
| 2,661,677 | A | * | 12/1953 | Lingelbach | 454/331 |
| 2,717,715 | A | * | 9/1955 | Whelan | 220/3.94 |
| 3,220,079 | A | * | 11/1965 | Aggson | 52/302.3 |
| 3,769,769 | A | * | 11/1973 | Kohl | 52/212 |
| 4,026,082 | A | * | 5/1977 | Crofoot | 160/104 |
| 4,676,145 | A | * | 6/1987 | Allred | 454/276 |
| 4,927,039 | A | * | 5/1990 | McNab | 174/57 |
| 5,014,610 | A | * | 5/1991 | Twito | 454/313 |
| 5,326,060 | A | * | 7/1994 | Chubb et al. | 174/48 |
| 5,444,947 | A | * | 8/1995 | Miller | 249/39 |
| 5,468,538 | A | * | 11/1995 | Nameche | 118/301 |
| 5,479,984 | A | * | 1/1996 | Easterbrook et al. | 165/96 |
| 5,568,947 | A | * | 10/1996 | Paquette | 285/192 |
| 5,615,850 | A | * | 4/1997 | Cloninger | 211/26 |
| 6,029,933 | A | * | 2/2000 | Holman et al. | 244/118.5 |
| 6,112,927 | A | * | 9/2000 | Gretz | 174/66 |
| 6,165,066 | A | * | 12/2000 | Sharp et al. | 454/271 |

FOREIGN PATENT DOCUMENTS

| | | | | | |
|---|---|---|---|---|---|
| FR | 2256377 | A | * | 8/1975 | B60H/1/26 |
| JP | 02001248873 | A | * | 9/2001 | F24F/7/10 |

* cited by examiner

*Primary Examiner*—Carl D. Friedman
*Assistant Examiner*—Brian E. Glessner
(74) *Attorney, Agent, or Firm*—Sand & Sebolt

(57) ABSTRACT

A connector frame for use as a support member for mounting grilles at ventilation openings in a building structure. The connector frame allows the grills to be mounted in slightly different locations to hide imperfections at the edges of the ventilation openings. The connector frame may include a pair of single connector frames that may be separated into two singly usable frames.

20 Claims, 8 Drawing Sheets

CONNECTOR FRAME FOR VENTILATION OPENING

CROSS REFERENCE TO RELATED APPLICATION

This application is a continuation-in-part application of U.S. patent application Ser. No. 09/146,671 filed Sep. 3, 1998, now U.S. Pat. No. 6,192,680 the disclosures of which are incorporated herein by reference.

BACKGROUND OF THE INVENTION

1. Technical Field

This invention relates to improvements in mounting grilles and louvers in the air duct outlets of heating and cooling systems in a building structure. Specifically, the invention relates to a frame positioned at the ventilation opening that allows a grill to be mounted to the frame.

2. Background Information

In forced air heating, cooling and ventilating systems, commonly referred to as HVAC systems, the rooms of the building structure usually have one or more open end duct portions of such systems entering into such rooms. It is normal practice to mount to the outlet ends of such ducts a grille or louver facing interiorly of the rooms. Such ends may be in single, double or multiple locations, spaced together or apart, for mounting the grilles in walls or ceiling for optimum distribution and/or collection of room air. The duct outlets are frequently located between wall studs or ceiling joists and their outlet grilles or louvers must be durably connected thereto preferably in air-tight replaceable arrangement. Air leakage around the grilles will result in inefficient air delivery and circulation as well as streaking or discoloration on adjacent walls or ceiling over time. Improper or insecure mounting of the grilles to wall studs or ceiling joists, or ducts per se, by juxtaposed mounting screws often requires the grilles to be attached to the studs or joists, or ducts, at odd angles in a non-uniform and insecure manner such as when the grilles are first attached and subsequently temporarily removed for wall painting or cleaning or other purposes.

Further, the outlet ends when open after duct installation and final construction of the building frequently allow dirt and building debris to enter the ducts which dirt and debris must be removed prior to temporary or final mounting of the grilles and operation of heating and cooling systems. Connection of the grilles to the metal duct ends, studs or joists poses a problem for unskilled construction workers and is very time consuming. It is very desirable to maintain cleanliness in the ducts during final construction to eliminate duct cleaning prior to overall building cleaning, dry walling, painting, wallpapering and operation of heating and/or cooling systems. Temporary installation of the grilles containing transparent plastic film or filters has been found to be highly desirable to maintain duct cleanliness both prior to and during initial operation of heating and cooling systems. The film and/or filters are usually removed prior to system operation.

SUMMARY OF THE INVENTION

The invention provides a connector frame that is positioned at the ventilation opening in a building structure. The connector frame carries a grill that covers the ventilation opening in an attractive manner.

The connector frame allows the grill to be attached to the frame in an adjustable manner so that wall covering imperfections can be selectively covered. The flanges of the connector frame define paired openings that allow the grill to be connected at different locations.

BRIEF DESCRIPTION OF THE DRAWINGS

In the accompanying drawings, the same reference numerals designate the same elements and component parts of the double and single connector frame in all views.

Similar numbers refer to similar elements throughout the specification.

DESCRIPTION OF THE PREFERRED EMBODIMENTS

Figure 1:
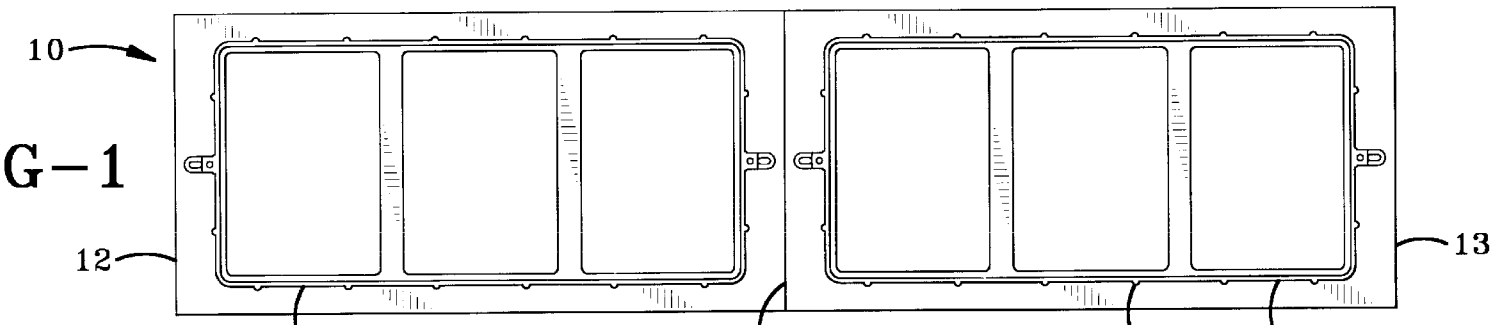
FIG. 1 is a front view of the improved rectangular double connector frame for connecting all ducts to grilles and louvers in a building structure indicating the medial line of severance for separating the double frame into two separate connectors.

FIG. 1 of the drawings illustrates a double connector frame 10 which has a rectangular shape and a much longer length dimension than the shorter width dimension. One preferred size of the frame is about 32 by 7½ inches, although the size may be varied widely. The connector frame 10 has a planar surface 11 on one side and a pair of spaced-apart precisely-similar smaller flanged frames 12 and 13 on its other side. FIG. 1 shows the two equal smaller frames 12 and 13 within the single larger frame 10. Both of the smaller frames 12 and 13 have open interior areas.

A medial line of severance 14 is shown in FIG. 1 centrally located between the two smaller frames 12 and 13. The severance line 14 comprises a small lineal recess for separation of main frame 10 into single similar frames 12 and 13 by cutting or deep scoring. Thus, frame 10 can be severed along medial line 14 into two equally dimensioned smaller flanged frames 12 and 13. Both smaller frames 12 and 13 have similar continuous peripheral flanges 15 and 16 extending around their perimeters with largely open areas there within.

Double frame 10 can be used to surround and be connected to a pair of side-by-side double duct outlets with no separation of its two smaller flanged frames 12 and 13. By separating the main frame 10, the two smaller frames may be used separately at spaced-apart locations to be mounted around two duct outlets. Main frame 10 has a uniform thickness of about 3/16 inch and preferably is comprised of molded polymeric material such as poly-propylene.

Figure 2:
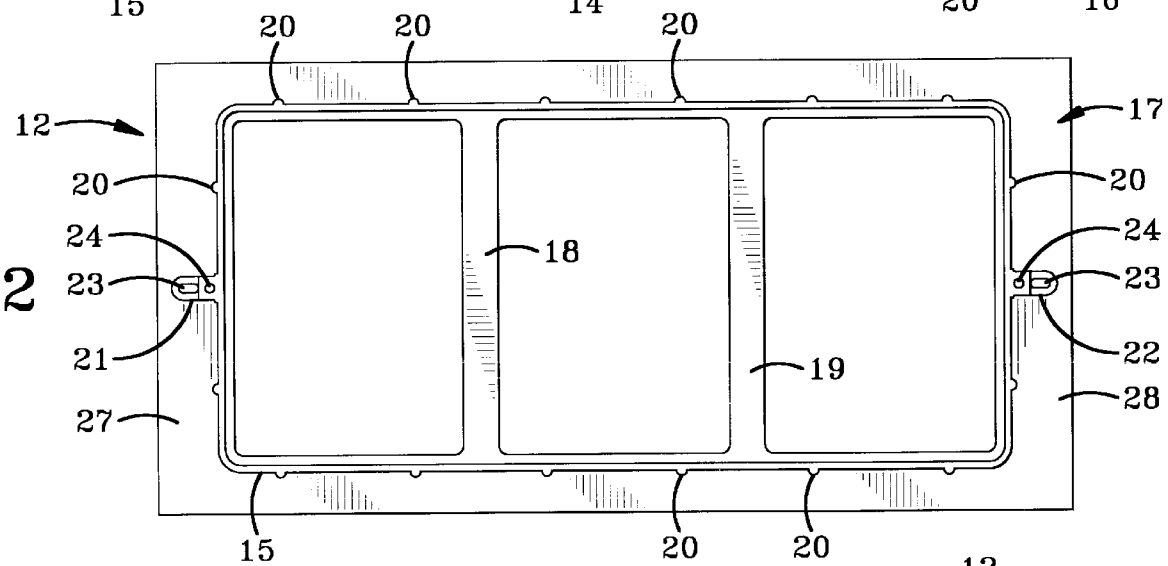
FIG. 2 is an enlarged front view of a single smaller connector frame separated from the double frame of FIG. 1.

The two smaller flanged frames 12 and 13, when separated, are precisely-similar in size and dimensions, and each has the rectangular shape shown in enlarged FIG. 2. The frame 12 is discussed here below, but the discussion also applies to the other frame 13 when separated. The rectangular flange 15 of frame 12 is located near its border 17 of nearly equal peripheral width. The open frame 12 has two intermediate members 18 and 19 which are extensions of its planar side, members 18 and 19 connecting the long axis sides of frame 12 for greater strength and stability. Integral members 18 and 19 of frame 12 extend through its open interior area. Members 18 and 19 have a similar thickness comparable to the border area 17 of the frame 12. The continuous flange 15 of frame 12 has a thickness of about 3/16 inch comparable to its border 17. A series of small spaced-apart ribs 20 are formed on all sides of continuous flange 15 to strengthen the flange, the ribs facing outwardly at preferably equispaced locations on opposing sides of the flange.

Figure 3:
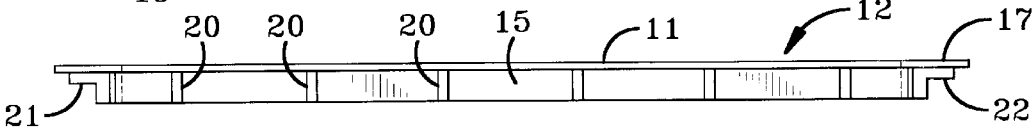
FIG. 3 is a top elevational view of the smaller flanged connector frame shown in FIG. 2.

A pair of outwardly-facing stepped projections 21 and 22 are formed medially on opposite short sides of frame 12 adjacent to and comprising a portion of flange 15. The projections 21 and 22 are formed with each step having one of two small apertures 23 and 24 to receive mounting screws to hold grilles or louvers rigidly in place when attached thereto. FIG. 2 shows the two juxtaposed stepped projections 21 and 22 centrally on the short axis sides of the frame 12 in the corners between flange 15 and the border 17 with the two small open apertures 23 and 24 on each side, one aperture on each step. FIG. 3 shows in a top plan view the frame 12 and its continuous flange 15 with the spaced strengthening ribs 20 on its upper side. This view also shows the stepped character of projections 21 and 22 formed outwardly of flange 15. The shorter step of projection 21 allows dry wall panels to be mounted against the higher step of the projection and its connector frame 12.

Figure 4:
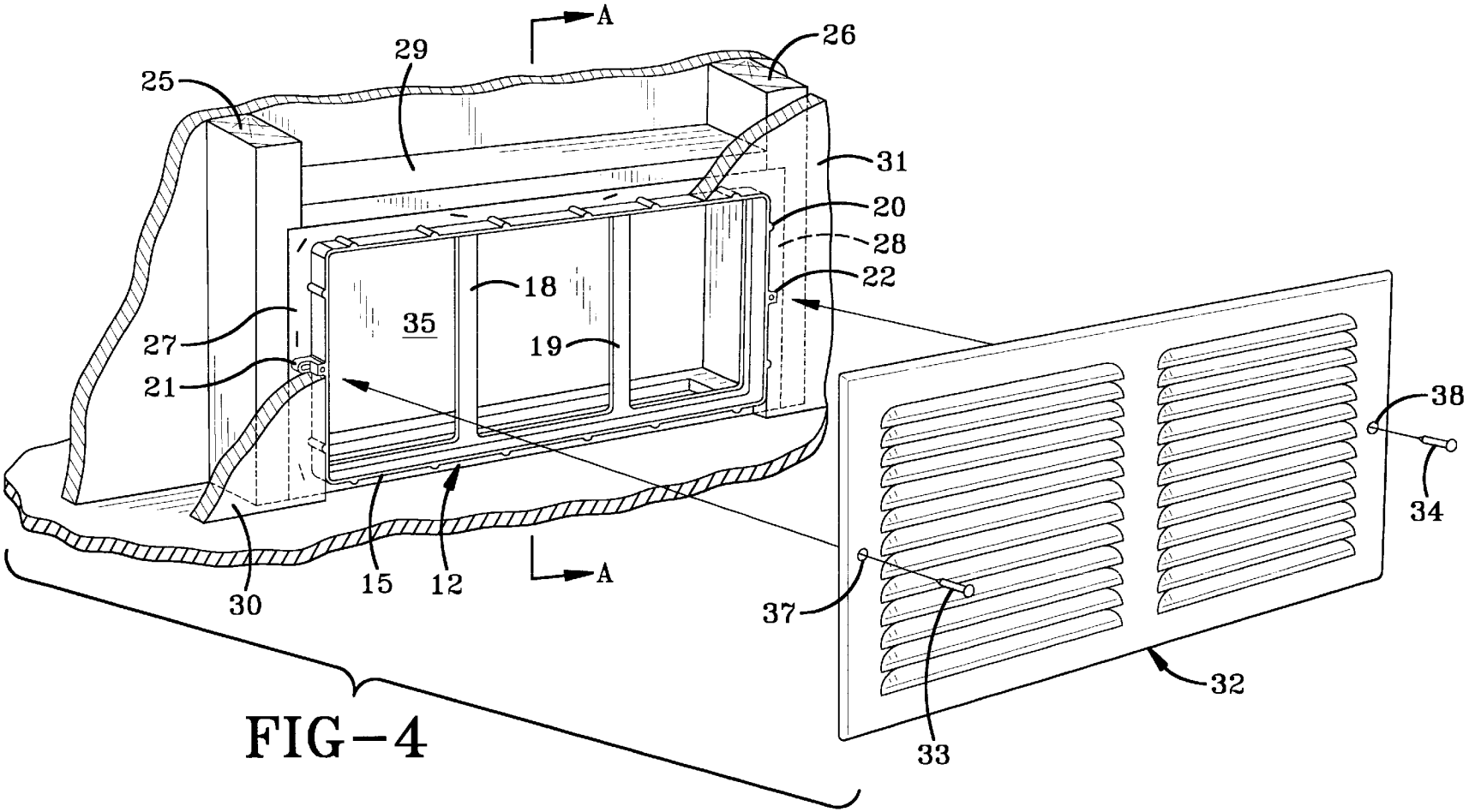
FIG. 4 is an exploded view of the single smaller flanged connector frame shown in FIGS. 2 and 3 showing the attachment of the connector frame surrounding and connected to a duct outlet with a return-air grille ready to be attached thereto.

FIG. 4 shows the subject connector frame 12 attached to spaced-apart studs 25 and 26 of a building structure. The short sides 27 and 28 of the frame border 17 are attached to the studs by stapling or nailing, for example, where the studs are normally comprised of wood. The flat face of frame 12 is directly attached to faces of parallel studs 25 and 26 and cross member 29 in the space therebetween. Cross member 29 is frequently mounted between the studs to form the duct opening 35 at the end of the duct. Dry wall members 30 and 31 are shown in FIG. 4 attached to the studs leaving the duct outlet 35 in open condition. A grille 32 is shown in FIG. 4 ready to be mounted on the connector frame 12 by a pair of threaded screws 33 and 34. The screws are connected to the open apertures in the frame projections 21 and 22 after their passage through mounting holes 37 and 38 in the grille 32. The dry wall panels 30 and 31 may be marked at locations of the lower projections for passage of screws through holes punched or drilled in the dry wall panel edges. The screws are preferably self-tapping for engagement in the opposing pair of apertures in projections 21 and 22 of the connector frame 12, depending upon the grille size.

Figure 5:
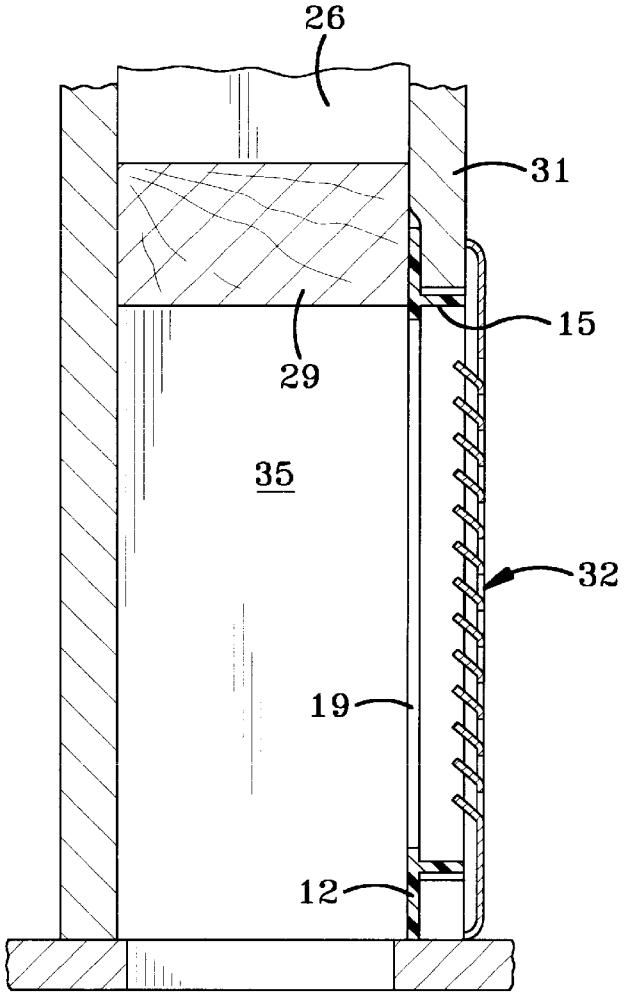
FIG. 5 is an enlarged vertical sectional view taken along the line A—A of FIG. 4 on a larger scale showing the duct outlet in a building wall, a flanged connector frame and grille mounted in place.

FIG. 5 shows in a vertical sectional view taken along line A—A of the connector frame 12 mounted on the perimeter of duct opening 35 in horizontal relation in a wall opening. The connector 12 may be similarly mounted on duct openings in ceilings as well as wall openings as desired or required. The grille 32 is directly attached to the connector frame 12 contacting the flanged edges of the frame 12.

Figure 6:
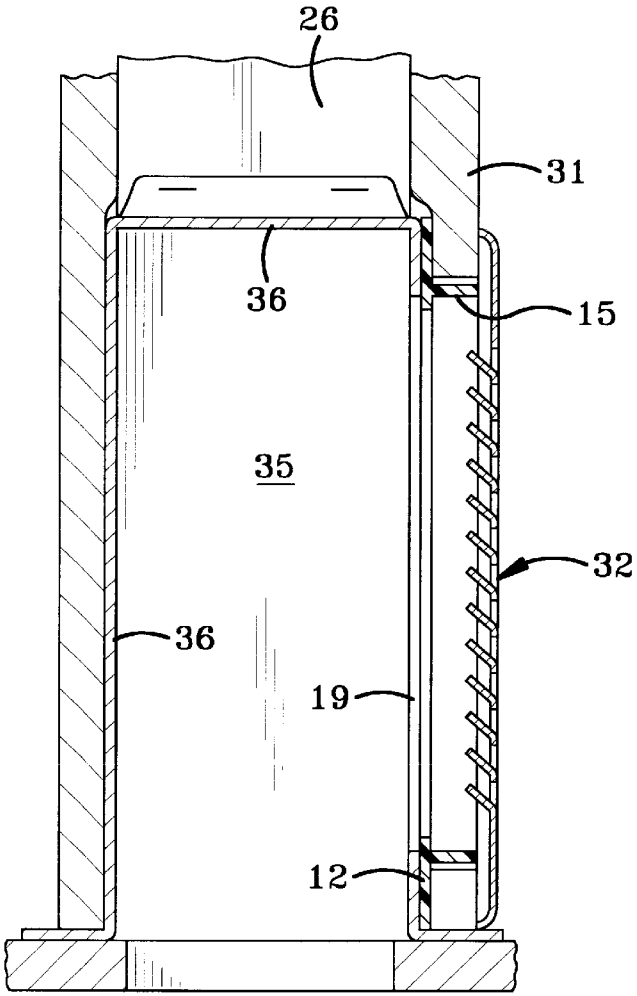
FIG. 6 is a view similar to FIG. 5 with a patented heat-resistant foil-faced duckboard material comprising the duct outlet material.

FIG. 6 is a view similar to FIG. 5 with the duct opening 35 formed of fireproof sheet duct material 36 sold under the name "Therm-O-Pan" as disclosed and claimed in U.S. Pat. No. 5,339,577 issued Aug. 23, 1994. The sheet duct material can be scored and bent into air ducts and stapled or nailed to the studs 25 and 26 to form the duct opening 35. The connector frame 12 is similarly attached to the periphery of duct opening 35 and the grille 32 attached to frame 12. Thus, the ducts can be formed of a wide variety of duct materials from sheet metal to essentially non-metallic sheet material.

Figure 7:
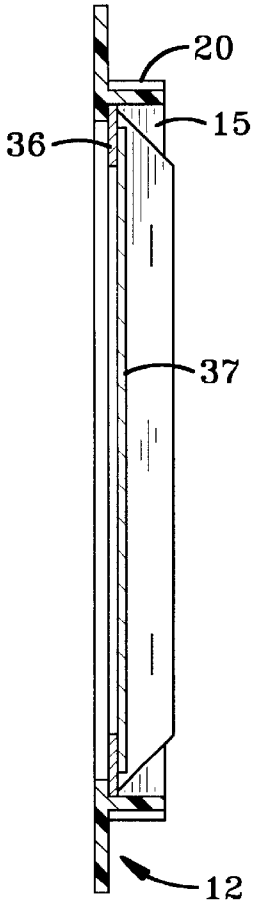
FIG. 7 is a vertical sectional view of the connector frame alone shown in FIGS. 5 and 6 having a filter member covering its open interior.

FIG. 7 shows the frame 12 along with a continuous layer 37 of porous filtering material such as fiber glass covering the open interior area of the frame. The filter may be temporarily installed in the frame 12 for initial operation of the heating or cooling system of the building to prevent dust particles from entering the room for their collection and disposal.

Figure 8:
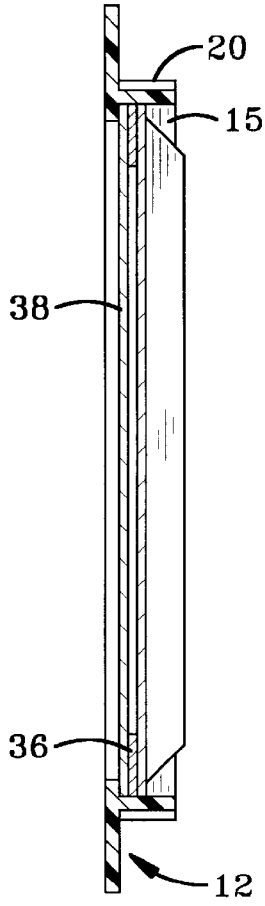
FIG. 8 is a view similar to FIG. 7 with a clear plastic film covering the interior open area of the connector frame.

FIG. 8 shows the frame 12 alone with a clear plastic film layer or sheet 38 covering the open area of the frame. The plastic film may be mounted on the flat surface 11 of the frame 12 for easy removal as desired. The transparent film sheet permits the construction workers to view the duct openings and prevent room dirt from room sources from entering the ducts during final construction. The filter or clear plastic materials are used as temporary measures to ensure duct cleanliness during latter stages of construction, such materials being mounted on frame 12 for their easy removal as desired before start-up of heating, cooling or ventilating systems. Clear or shaded or translucent plastic film, may be used on the connector frames and be peeled off prior to forced air passage.

Figure 9:
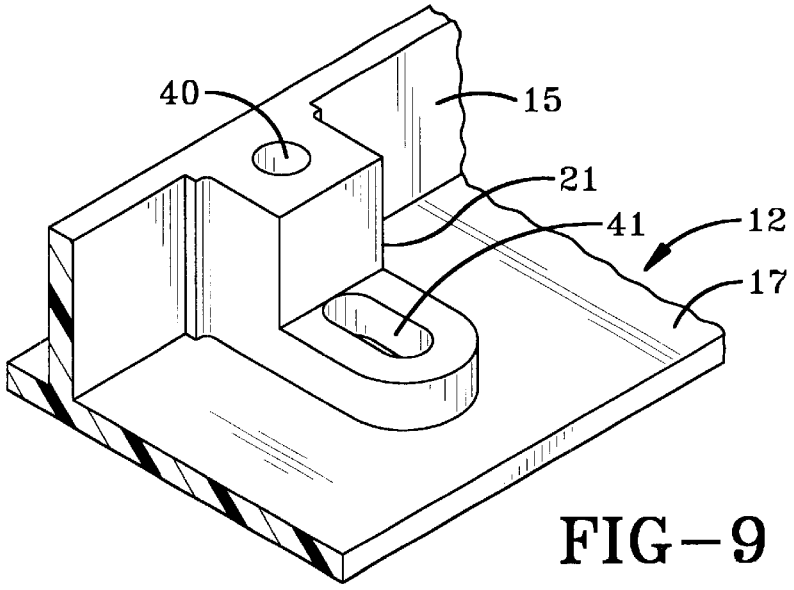
FIG. 9 is an enlarged fragmentary perspective view of the apertured projections located medially along the short axis sides of the connector.

FIG. 9 shows in an enlarged fragmentary view the projection 21 on frame 12 having the stepped contour with an aperture in each of the two steps. Aperture 40 is formed on the higher step and aperture 41 is formed on the lower step. Either of the pair of similar apertures on both sides of the frame may be used for grille attachment depending upon its standardized size.

The connector is normally mounted in level arrangement with a carpenter's level placed on its upper edge to mount the frame on the duct opening in a wall in horizontal relation. The border area 17 of the connector has a series of spaced markings molded into its sides to facilitate stapling or nailing of the connector to the wall studs. When the filter or transparent or translucent plastic film is utilized within the open area of the connector, such materials are quickly removed prior to operation of HVAC systems. The filter allows air to pass through but stops and collects dust and dirt from entering the room interior. The connector fits most commonly manufactured grilles and louvers having screw holes on their short sides in 30 by 6 and 14 by 6 inch sizes, for example. The connectors are made with safety edges and all sides and edges are so made for ease of handling and installation.

An alternative embodiment of the connector frame of the present invention is indicated generally by the numeral 100 in FIGS. 10–15. Connector frame 100 generally has a rectangular shape with a longer length dimension and a shorter width dimension. Connector frame 100 is configured to be broken into two independently-usable connector frames 102. A scored severance line 104 is disposed in the body 106 of frame 100 to allow frames 102 to be separated. Line 104 may be defined in either the front or rear surface of body 106.

At least a first flange 110 projects outwardly from body 106. Flange 110 may be continuous as shown in the drawings or may include spaced sections disposed about the perimeter of the opening 112 of frame 100. A second flange 114 extends outwardly from body 106 about opening 116 when body 106 is configured to form two frames 102. Flanges 110 and 114 are aligned in along the horizontal dimension so that frame 100 may be used in a single large opening.

Figure 10:
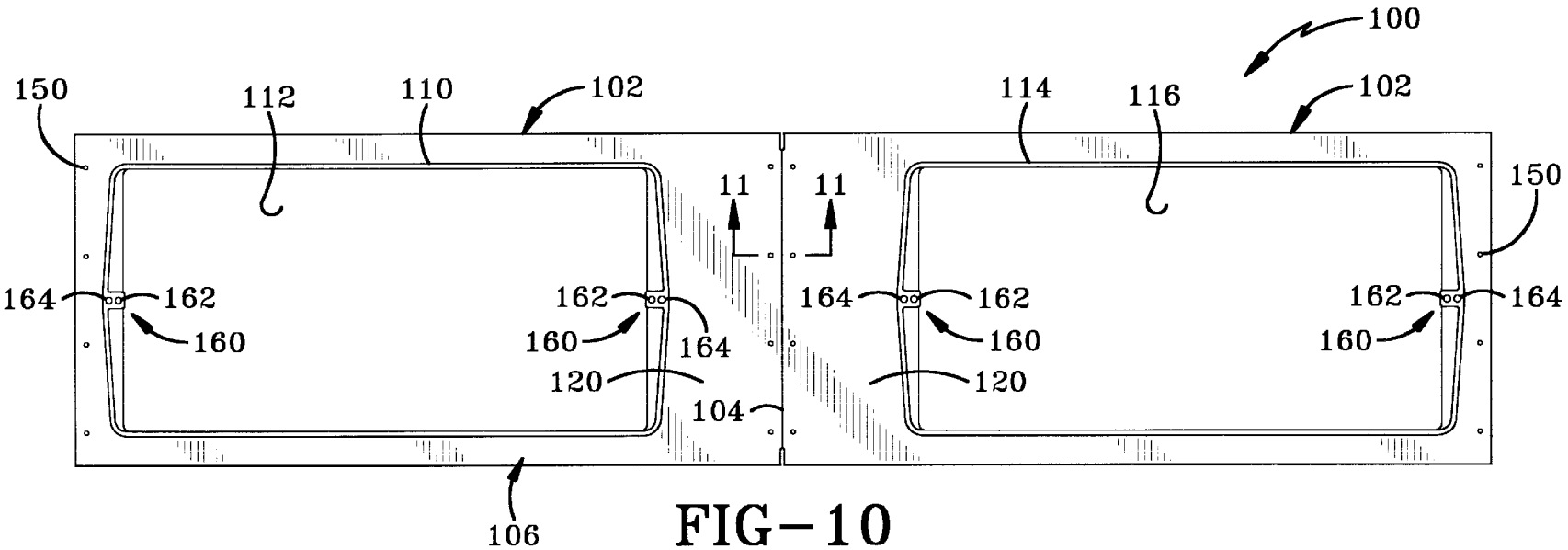
FIG. 10 is a front elevation view of an alternative embodiment of the connector frame of the invention.
Figure 11:
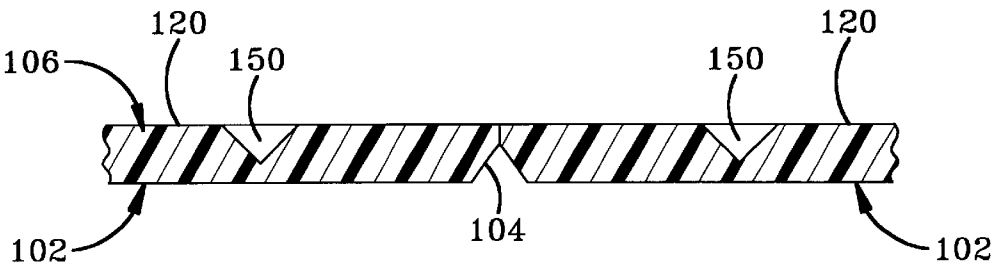
FIG. 11 is a section view taken along line 11—11 of FIG. 10.
Figure 12:
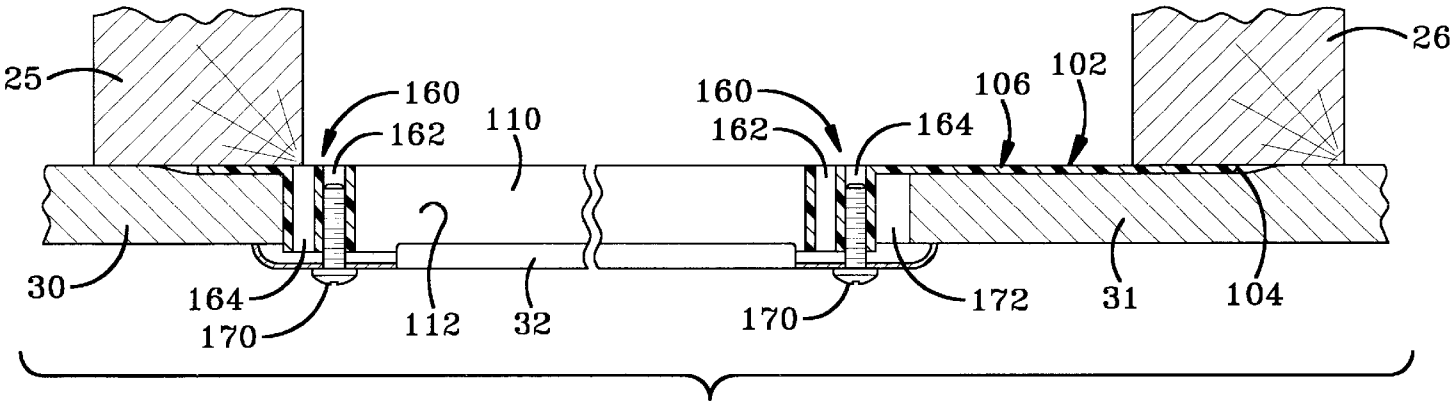
FIG. 12 is section view of a small grill attached to the connector frame with the grill shifted to the right.
Figure 16:
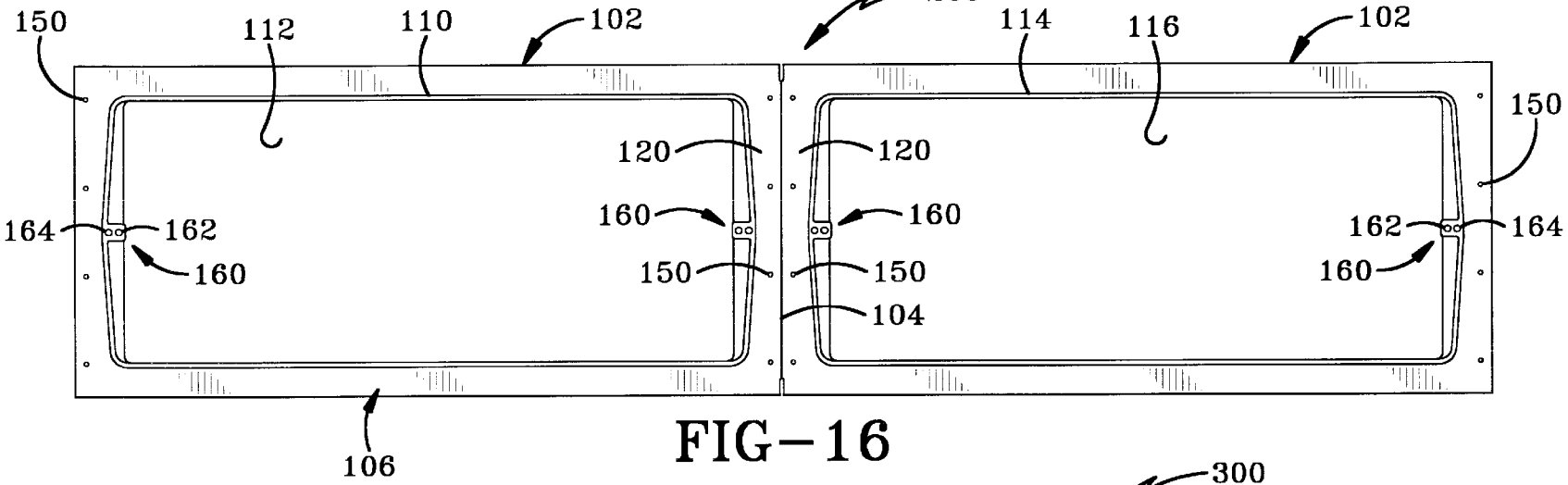
FIG. 16 is a view similar to FIG. 10 showing an alternative embodiment of the invention used with larger ventilation openings.
Figure 17:
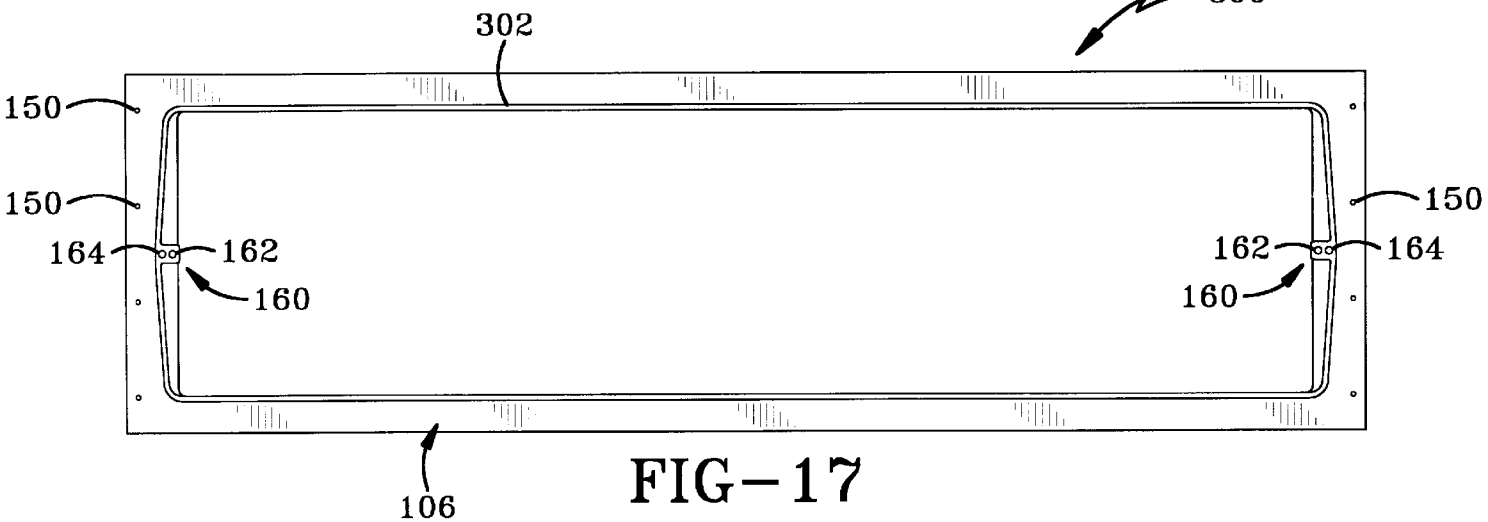
FIG. 17 is a view similar to FIG. 16 showing an alternative embodiment of the invention for use with a single ventilation opening.

Body 106 includes wide side portions 120 that allow the size of flanges 110 and 114 to be adjusted for different width grills 32. In FIG. 10, frame 100 includes broad side portions 120 so that flanges 110 and 114 are configured for smaller openings such as 12.5 inches with an combined width of 30.5 inches. In FIG. 16, an alternative frame 200 is depicted wherein flanges 110 and 114 are sized for grills 32 that are 14.5 inches wide with a combined width of 30.5 inches. In frame 200, side portions 120 are smaller than in frame 100. In FIG. 17, an alternative embodiment 300 is depicted that includes a single flange 302 sized to receive 24 inch grills.

In each of embodiments 100, 200, and 300, body 106 defines scored screw holes 150 that help the user to position screws and help the screws bite into body 106.

Figure 13:
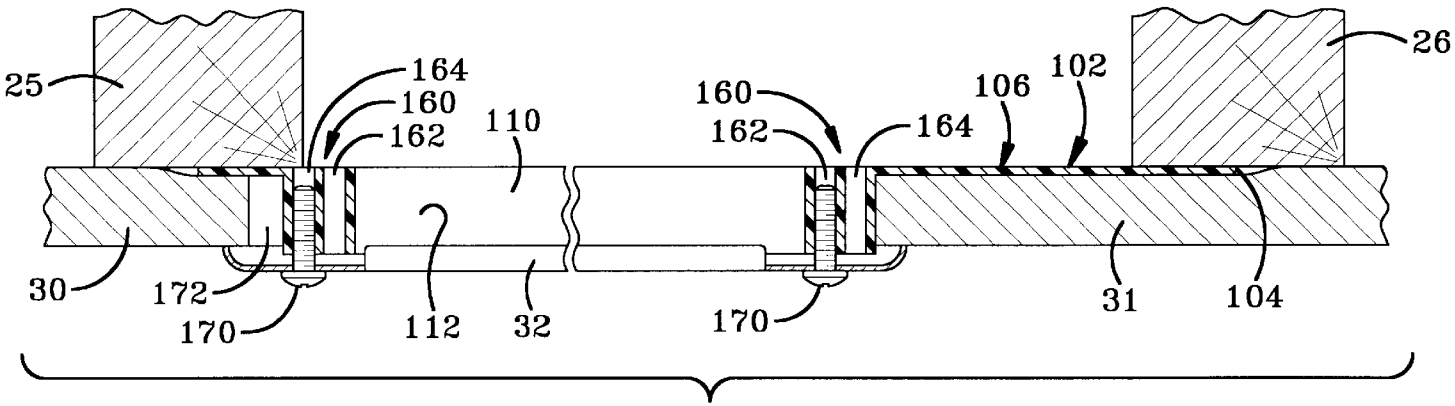
FIG. 13 is section view of a small grill attached to the connector frame with the grill shifted to the left.
Figure 14:
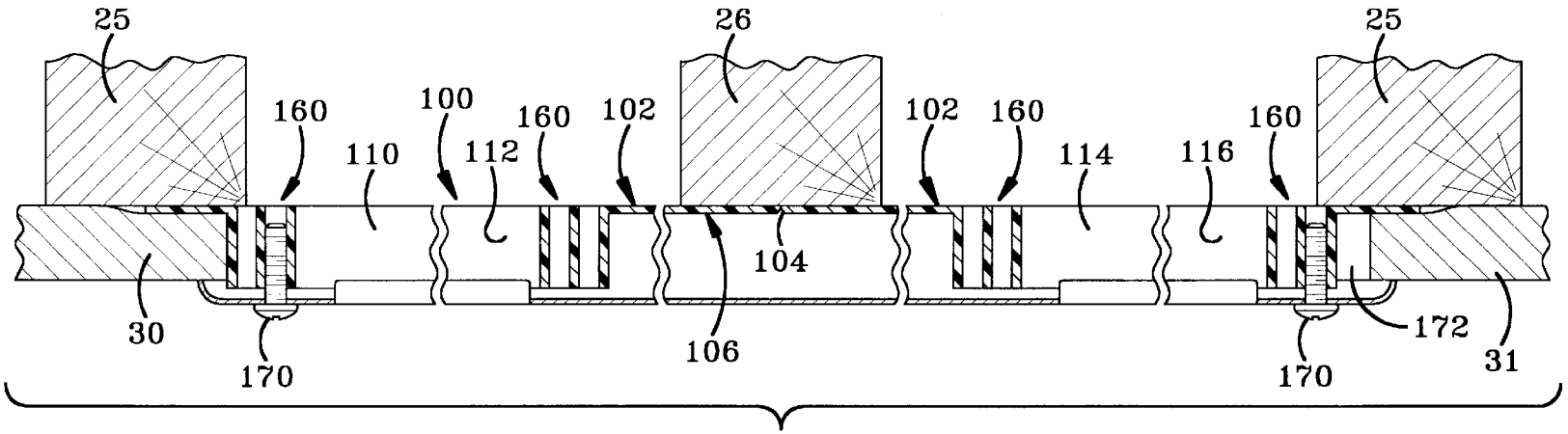
FIG. 14 is section view of a large grill attached to the connector frame with the grill shifted to the right.
Figure 15:
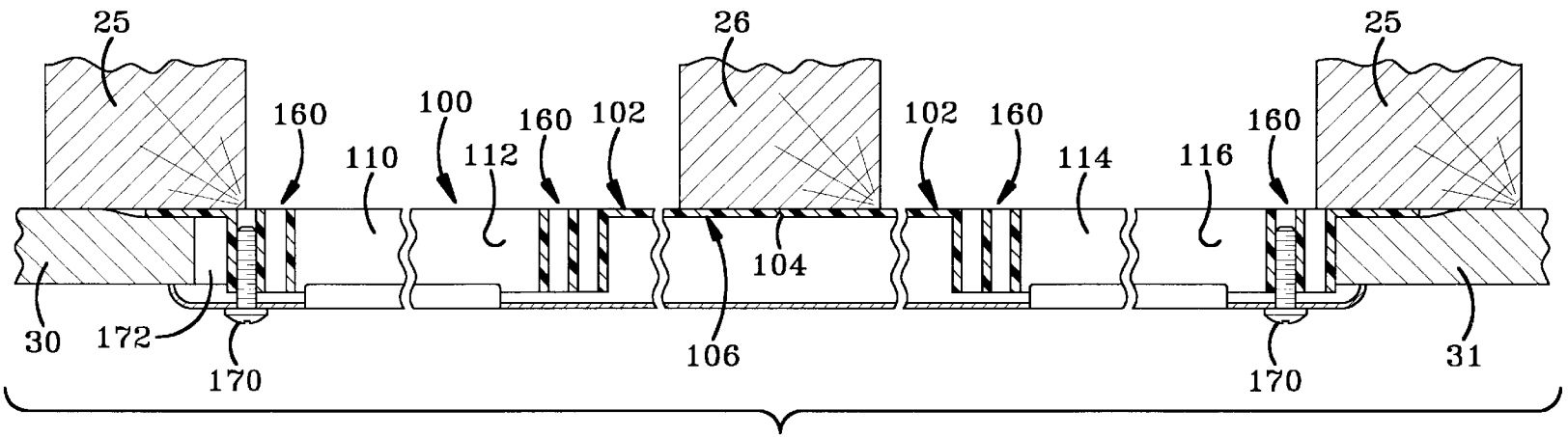
FIG. 15 is section view of a large grill attached to the connector frame with the grill shifted to the left.

In each of embodiments 100, 200, and 300, the flanges define opposed pairs of paired connector openings 160 having openings 162 and 164. Paired connector openings 160 are disposed between the flange and the opening. Openings 162 and 164 are spaced apart to align with standard grill holes so that grill 32 may be adjustably mounted on the frame. For example, in FIGS. 12 and 14, grill 32 is attached to frame 102 with connectors 170 disposed in opening 162 on the left hand side and opening 164 on the right hand side. This configuration allows grill 32 to cover an imperfection 172 disposed on the right hand side of the opening where cover member 31 has been cut too short. In FIGS. 13 and 15, imperfection 172 is disposed on the left hand side and grill 32 is thus moved over by switching connector openings. In other embodiments, grill 32 may have openings that align with both openings 162 or both openings 164. Pairs 160 thus allow different grills 32 to be used with frame 102.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. In combination, a building structure and a connector frame that supports a ventilation grill at a ventilation opening:

the building structure having a first support element and a cover member defining at least part of a ventilation opening;

the support element having a first surface;

a connector frame connected to one of the cover member and the support element;

the connector frame having a body and a first flange; the body defining a first opening;

a portion of the body being disposed between the first support element and the cover member;

a first flange positioned at one side of the opening;

the first flange forming a continuous wall about the first opening;

the first flange being disposed in the ventilation opening of the cover member;

a grill connected to the connector frame; and the connector frame defining a second opening adjacent the first opening;

the connector frame also including a second flange positioned at one side of the second opening; the second flange forming a continuous wall about the second opening; the second flange projecting from the same side of the connector frame as the first flange.

2. The combination of claim 1, wherein each flange defines a pair of paired connector openings disposed along the flange.

3. The combination of claim 1, further comprising a ventilation duct connected to the body of the connector frame.

4. The combination of claim 1, further comprising a removable membrane extending across the first opening of the connector frame.

5. The combination of claim 1, further comprising a removable layer of porous filtering material extending across the first opening of the connector frame.

6. The combination of claim 1, wherein the building structure is one of a wall, a floor, and a ceiling.

7. The combination of claim 1, further comprising a plurality of ribs extending between the first flange and the body.

8. The combination of claim 1, wherein a portion of the cover member is disposed between the body of the connector frame and the grill.

9. The combination of claim 1, wherein the connector frame defines connector openings on opposite sides of the ventilation opening; the openings receiving portions of connectors that connect the grill to the connector frame.

10. The combination of claim 9, wherein the connector frame defines a pair of connector openings on both sides of the ventilation opening.

11. The combination of claim 10, wherein the ventilation opening has a width and a length; the pairs of connector openings being aligned along a reference line substantially parallel to the length dimension of the opening.

12. In combination, a building structure and a connector frame that supports a ventilation grill at a ventilation opening:

the building structure having a first support element and a cover member defining at least part of a ventilation opening;

the support element having a first surface;

a connector frame connected to one of the cover member and the support element;

the connector frame having a body and a first flange; the body defining a first opening;

a portion of the body being disposed between the first support element and the cover member;

the first flange positioned at one side of the first opening;

the flange substantially surrounding the first opening;

the first flange being disposed in the ventilation opening of the cover member;

a grill connected to the connector frame;

the connector frame defining a second opening adjacent the first opening;

the connector frame also including a second flange positioned at one side of the second opening;

the second flange substantially surrounding the second opening; and the second flange projecting from the same side of the connector frame as the first flange.

13. The combination of claim 12, wherein the connector openings are disposed between the flange and the first opening.

14. In combination, a building structure and a connector frame that supports a ventilation grill at a ventilation opening:

the building structure having a first support element and a cover member defining at least part of a ventilation opening;

the support element having a first surface;

a connector frame connected to one of the cover member and the support element;

the connector frame having a body and a first flange; the body defining a first opening;

the first flange surrounding the first opening;

the first flange defining one pair of paired connector openings on opposed sides of the first opening; the four connector openings being disposed on a common reference line;

the first flange being disposed in the ventilation opening of the cover member; and a grill connected to the connector frame with connectors disposed in a portion of the connector openings.

15. The combination of claim 14, wherein the connector openings are disposed between the flange and the first opening.

16. The combination of claim 1, wherein the body defines a scored line disposed between the first and second openings.

17. The combination of claim 16, wherein the scored line includes first and second ends; the body defining notches at the first and second ends of the scored line.

18. The combination of claim 2, wherein the four connector openings are disposed along a common reference line.

19. In combination, a building structure and a connector frame that supports a ventilation grill at a ventilation opening:

the building structure having a first support element and a cover member defining at least part of a ventilation opening;

the support element having a first surface;

a connector frame connected to one of the cover member and the support element;

the connector frame having a body defining first and second spaced openings; a first flange surrounding the first opening; a second flange surrounding the second opening; the first and second flanges projecting from the same side of the body; and the body defining a scored line disposed between the first and second openings.

20. The combination of claim 19, wherein the scored line includes first and second ends; the body defining notches at the first and second ends of the scored line.

* * * * *